US007626106B2

(12) United States Patent
Stannard

(10) Patent No.: US 7,626,106 B2
(45) Date of Patent: Dec. 1, 2009

(54) PERCUSSION INSTRUMENTS USING MOLTEN OR PLASTICIZED METAL

(76) Inventor: John Stannard, c/o 2140 Range Rd., Unit C, Clearwater, FL (US) 33765

( * ) Notice: Subject to any disclaimer, the term of this patent is extended or adjusted under 35 U.S.C. 154(b) by 238 days.

(21) Appl. No.: 11/566,343

(22) Filed: Dec. 4, 2006

(65) Prior Publication Data

US 2007/0131090 A1 Jun. 14, 2007

Related U.S. Application Data

(60) Provisional application No. 60/742,237, filed on Dec. 5, 2005, provisional application No. 60/830,001, filed on Jul. 11, 2006.

(51) Int. Cl.
*G10D 13/02* (2006.01)

(52) U.S. Cl. ..... 84/422.1; 84/402

(58) Field of Classification Search ..... 84/422.1, 84/422.3, 402, 406
See application file for complete search history.

(56) References Cited

U.S. PATENT DOCUMENTS 4,079,163 A * 3/1978 Tanaka et al. ..... 428/328

FOREIGN PATENT DOCUMENTS

KR 2005082756 A * 8/2005

* cited by examiner

*Primary Examiner*—Kimberly R Lockett
(74) *Attorney, Agent, or Firm*—Allen Dyer Doppelt Milbrath & Gilchrist

(57) ABSTRACT

Cymbals and generally flat sheet instruments, as well as compound instruments, are formed using welding process and metal melting processes to form holes and edges with thickened edges from the melting processes, to join sections of metal, to add metal by creating beads at desired locations, to join sections with differing hardness and/or thickness, to create compound cymbals and compound flat sheet instruments by joint welding cymbals or sheet instruments together. The invention also includes cymbals and bells and various combinations and shapes thereof and the unique overtones attained thereby.

15 Claims, 21 Drawing Sheets

PERCUSSION INSTRUMENTS USING MOLTEN OR PLASTICIZED METAL

RELATED APPLICATIONS

This application claims the benefit of U.S. Provisional Patent Application Ser. No. 60/742,237 filed Dec. 5, 2005 and U.S. Provisional Patent Application Ser. No. 60/830,001 filed Jul. 11, 2006.

FIELD OF THE INVENTION

This invention related to percussion instruments, including cymbals and percussion sheet style instruments constructed using molten or plasticized metal processes to obtain desired unique sounds and overtones and including cymbals and bells and various combinations and shapes thereof and the unique overtones attained thereby.

BACKGROUND OF THE INVENTION

Cymbals have always been constructed of a single piece of metal. Thin, relatively flat or "sheet" instruments such as thundersheets were never welded or constructed using molten or plasticized metal after reduction—they were always plain sheet metal or flat rolled metal.

Furthermore, cymbals have always utilized metal which is first cast of molten metal which is then cooled, then reduced into a thinner section through cold or hot hammering or rolling. A thinner section is defined here as metal which is under 3/16 (0.187) inch thick.

During the rolling or hammering and subsequent shaping and thinning, the metal was often heated to increase ductility but further use of molten metal has never been anticipated.

To create a change in thickness—often a tapering reduction from a thick center to a thin edge, cymbals were typically lathed, hot rolled, cold rolled or hammered.

A method of adding or thickening material has not been anticipated or taught by prior art. When holes were created in prior art, they were created by material removal methods which leave a substantial scrap piece, and any evidence of a thicker section at the edge of the cut was obliterated by a deburring process.

Cymbals were welded at the center node only as a mounting system for a single cymbal to a stand or holding device. Two or more cymbals have never been welded together to form a compound instrument.

The overall sound of a percussion instrument such as a cymbal or thin, sheet-like instrument consists of a multiplicity of sounds—each of differing frequency. These partial tones which combine to make the overall sound are called overtones.

Cymbal makers have always sought out new ways of adding and altering the structure, and rise and fall in amplitude of overtones.

Sales of various types of cymbals and percussion instruments prove that while there may be established sounds which aid in the sales of these products, there is no absolute standard of sound quality—any significant alteration of the overtone structure (especially ways to add overtones) seems to create added value in the marketplace.

The following definitions are helpful in understanding the invention described below:

Bells and Cymbals

The main difference (in definition) between a bell and a cymbal within the context of this invention is the gauge or thickness of the sections utilized. When thicker metal is utilized for said instrument, the overtone structure and attack resemble that of a bell. Accordingly, a bell as used hereinafter is considered to be synonymous with a percussion instrument similar to a cymbal in concept, except made with a thicker gauge material. When thinner more flexible metal sections are used, the added flexibility can result in the formation of the complex overtone structures of cymbals. The ratio of thickness to diameter or surface area is important in the distinction between bell versus cymbal sounds. For example, if sections are 0.040 inches thick with a diameter of 5 inches, the resulting sound will, (due to relative stiffness), resemble that of a small bell. If however the same 0.040 thickness were used to make a 20 inch diameter instrument, the resulting sound would resemble, (due to flexibility and the complex swell and overtone structure), the sound of a cymbal. The radius of the "bow" also affects a bell versus cymbal sound. A deep or smaller radius bow can sound more like a bell where a larger or shallow radius can result in a more cymbal-like sound.

The terms defined will be used here interchangeably with regard to both cymbal and bell embodiments.

SHEET INSTRUMENT: A thin section of metal between about 0.010 inches and 0.100 inches thick, which is configured to form a resultant generally planar thin sectioned metal sheet shaped or sheet styled instrument. The sections can be cast and rolled individually to a desired thickness, or cut from larger sheets, coils, or strips which have been precast and rolled to thickness.

HYBRID INSTRUMENT: An instrument which, due to specific forming techniques, shapes, and materials, is configured and supported in such a way as to produce sounds similar to both cymbals or bells and gongs.

HYBRID CYMBAL/BELL INSTRUMENT: A compound percussion instrument in which a cymbal and bell are joined together by welding in a manner, which results in an instrument which is capable of producing both bell and cymbal sounds.

CUP: A term in cymbal vernacular to describe the raised or sunken dome or bell-shaped area in the center of a cymbal. Within the context of this invention, the term cup may also be used to describe a member which is welded onto the main body of a compound instrument such as a bell, bell-cymbal hybrid or cymbal which functions in a manner similar to that of a formed cup found in a conventional cymbal.

BOW or PROFILE: A term in cymbal vernacular to describe the main curve or overall dome radius of a cymbal, excluding the radius and shape of the center cup.

TAPER: A term in cymbal vernacular whereby the cymbal has a progressively thinner cross section proceeding from the thickest area in the center toward the thinnest cross section at outer edge of the cymbal.

OVERTONES: Overtones can be heard as simpler or individual tones or frequencies which when combined make up the whole of a musical sound. The sum of simple sounds such as sine waves, rising and falling in amplitude and frequency can produce a complex sound. In cymbals and bells there is a complex matrix of overtones comprising the whole.

SWELL: A term in music and in describing cymbal, bell, and gong sound whereby sound grows in time from low to high amplitude. In cymbals, gongs and bells, a rise in the frequency and complexity or number of overtones accompanies the rise in amplitude.

ATTACK: The sound heard immediate after the striking of a percussion instrument. The attack is also defined as amount of time it takes for the sound of a percussion instruments to reach full volume or amplitude after a single strike. An instrument with a large amount of swell (such as a large gong struck with a soft mallet) would have a slow attack. An instrument such as a bell struck with a metal clapper, a thick cymbal struck with a drumstick, or a triangle would have a fast attack.

SUMMARY OF THE INVENTION

The present invention utilizes molten or plasticized metal after the metal has been reduced to a thin section or sections.

Embodiments include:

1. Holes, edges and other sections in the instrument which are melted into the instrument by a torch or thermal friction drill or other method leaving little or no scrap pieces. Molten or fused metal collects around the edge of the hole into a thicker section. This thicker section surrounding the hole changes the elasticity and weight of that area of the instrument which can, depending on other design factors, add overtones to the sound of the instrument—resulting in a more complex and otherwise unique sound. Depending on the alloy used and further use of cold forming in the melted area, pronounced changes in hardness can be achieved. These various areas of hard and soft metal can also add overtones.

2. Welding. Welding can be defined as the joining of two or more pieces or amounts of metal of one or more alloys by means of heat which fuses metals together. The metal can become molten but can also be welded by friction and other methods whereby the pieces to be joined reach a plasticized condition and fuse together.

This can be accomplished by laser, gas, electrical arc, friction, and other means. In this invention, sections can be fused directly together, or a "bead" of molted metal can be applied to one or more sections. For this purpose, a bead is defined as any amount of molten metal which is fused onto or added to the surface of an existing part of the product.

Cymbals and thin "sheets" can also be welded together to form "hybrid" multi-cymbals.

Many of the same principles stated above in embodiment #1 above apply to welded instruments, especially in the use of a "bead" which creates a thicker section of metal.

Thermal or friction drilling or stir welding can also be used as a form of welding.

Benefits of this invention include:

a. The creation of cymbals and sheet instruments made from multiple alloys and multiple thicknesses which yield unique sounds and provide economical use of metal since thick areas can be created without use of material removal methods such as lathing and holes can be created without scrap and loss of mass.

b. The creation of new area-specific structural features which affect elasticity and sound conductivity by altering the nature and/or location of nodes and antinodes. Each differing pattern of welding can increase the complexity of the overtone structure in a different way, allowing for creation of many new sounds.

c. The creation of new metallurgical grain structures which affect strength and alter or increase overtones.

d. The creation of thick sections at mounting holes which reduce wear to the instrument, reduce cord wear in suspended instruments and alter sustain.

e. Areas of differing hardness which alter grain structures, overall strength and increase overtones.

f. In multi-alloy instruments alteration of sound and economy of material can be achieved through the use of two or more alloys. For instance, in a compound cymbal, the upper welded bell may be made of an alloy material with certain sound qualities needed for a clear bell-like tone. The lower section alloy may be chosen based on complexity of overtones and strength for striking at the edge. Different alloys could be used which respond differently to heat treatment resulting in decorative as well as changes in sound.

g. The creation of instruments welded from sections of differing hardness which can add overtones.

h. The creation of a cymbal where various objects can be welded to the main section to alter the overtone structure.

i. The creation of an instrument which responds differently to heat treatment in different sections, resulting in a decorative change in color differences in said different sections For example, in an instrument which features a bead welded to the surface, the thicker bead area will heat at a different rate than the adjacent thin area and a pronounced color change can be evident.

The invention further demonstrates that cymbals and bells can be joined together in intimate contact through welding or any process which results in a molecular bond between the sections to create a bell or cymbal instrument with 2 or more distinct sections which vibrate both independently and through shared vibration to form a new and novel instrument. These new instruments can also feature a shared, resonant air chamber or cavity created by the gap and close proximity of the multiple sections. Such an air cavity can amplify the low frequency overtones of said instrument to create a novel sound.

These embodiments bring the use of sympathetic vibration and the use of a shared air cavity to unforeseen levels which prior art could not anticipate.

One important and unexpected result of welding together two or more bells or cymbals in many variations of these embodiments, is that an increase in overall amplitude results which exceeds the combined loudness of the two or more separated, individual bells or cymbals. This can be useful since rising costs of metal have created a need for more efficient production of loud sounds.

It is important to attain the intimate contact and molecular bond that welding can achieve in order to maximize conduction of sound. If sections of metal are held tightly with bolts or fasteners, the superior conduction of sound heard in this invention will fail to occur.

Multiple Bells and Cymbals with a Common Resonating Air Cavity

In this embodiment, two or more members are welded together to form a bell and/or cymbal instrument with a common resonating air cavity which can increase the amplitude of the instrument, especially in the low and mid-range frequency spectrum.

Features which can combine to create the novel nature of this embodiment are:

1. The creation of a multiple section bell or cymbal instrument which with two or more distinct sections which vibrate both independently and through shared or sympathetic vibration.
2. The creation of a common resonating air cavity which alters the relative overtone structure of the instrument.

The size or diameter of the weld area in such embodiments influences the independence of the vibrating sections. A small weld area which is closer to the center node area will result in more independent vibration, while a large weld area which is farther from the center node area will result in less independent vibration.

The processes and material used for both bells and cymbals in this invention are for the most part, interchangeable.

Since sections of differing gauge, taper, and shape can be used, a bell and a cymbal can be combined to form a hybrid instrument.

The shape of the sections to be welded together, the gap between the sections, the method of fusion, the surface treatment such as hammered or pressed or rolled deformations in the material, the hardness of the material, the basic material or alloys used, the use of heat affected zones, the size and thickness of the sections and the area where fusion takes place all influence the sound and performance of this invention.

Metal is the preferred material of choice for this instrument class, although other materials could be used such as ceramics, glass, wood, plastics, or composite materials.

The preferred method of joining metal here would be a welding process whereby two or more sections would be first formed, then welded to join the sections, said welding process being one of the later stages of production.

One possible shape which is effective in the creation of a common resonating air cavity is to join two sections which resemble two cymbals whereby the center "cups" are formed in a direction opposite that of a conventional western or turkish style cymbal. The said aforementioned cups in this embodiment are formed by making a curved depression in the center of the domed section, said depression forming a curve in the opposite direction of the primary curve or "bow" of the cymbal or bell. The creation of said cups allow the two sections to be joined in the center while the dome or bow of each section form opposing curves which form an air cavity between the sections which, through resonance, boosts the amplitude of lower frequency overtones.

In such embodiments, each section will feature a center hole. The smaller of the two holes will be known here as the primary hole which is used for mounting or attaching the bell or cymbal to a cymbal stand or other method of mounting the instrument.

One of the two sections will usually have a larger secondary hole in the center than the other section. Around this larger hole, a weld joint will cover a larger area rather than a single point of contact. The size of the weld area will affect the invention in two ways: The larger weld area will be much stronger than a single point of contact.

By welding the section with the larger hole to the section with the smaller center hole, a ring shaped weld of considerable strength is formed.

Variation in the size of the weld area will affect sound conduction between the sections of metal, hence affecting the sound quality of the invention.

Embodiments of this instrument which feature a larger secondary hole will conduct more vibration between the sections yielding a sound of generally higher amplitude and will feature less independence of vibration between the two sections.

Embodiments of this instrument which feature a smaller secondary hole will conduct less vibration between the sections yielding a sound of generally lower amplitude and will feature more independence of vibration between the two sections.

One alternative to forming each cup within each singular section of metal is to form two separate dome shapes for each section, then to cut a hole in each large section and weld domes into said large sections.

Such an instrument will be constructed of four sections with a total of three weld areas. The said weld can be a ring shaped circular weld or other shapes. One advantage of this method is that it allows the center welded cup area to be of substantially different thickness or "gauge" versus the outer, large dome. This also allows the mounting hole to be of a thicker gauge to add strength. In this embodiment, the main difference between bells and cymbals lies within the thickness of the metals used and the relative diameters of the sections.

Large, thin, flexible sections will take on some of the vibrational characteristics of cymbals such as very complex structure of overtones. Thicker, smaller, more rigid sections will exhibit some of the characteristics of bells such as clearly defined and prominent overtones and less complex overtone structure than cymbals. The use of differing thickness or "gauge" of material can yield a hybrid sound between bells and cymbals. For example, if a section comprised of material of 0.070 inches in thickness is fused or welded to another thinner, more flexible section of material of 0.025 inches in thickness, the result will be the creation a hybrid instrument which when struck on the thinner, more flexible section will yield a considerably different sound than when struck on the thicker, stiffer side. In variations of size and thickness of material, this embodiment yields new and novel sounds yet unheard.

A wide variety of combinations of shapes (as seen when viewed from both above and/or as seen from cross sectional views) can be utilized to form complex and novel new compound cymbal and bell instruments.

BRIEF DESCRIPTION OF THE DRAWINGS

In the accompanying drawings.

DETAILED DESCRIPTION OF THE INVENTION

Figure 1A:
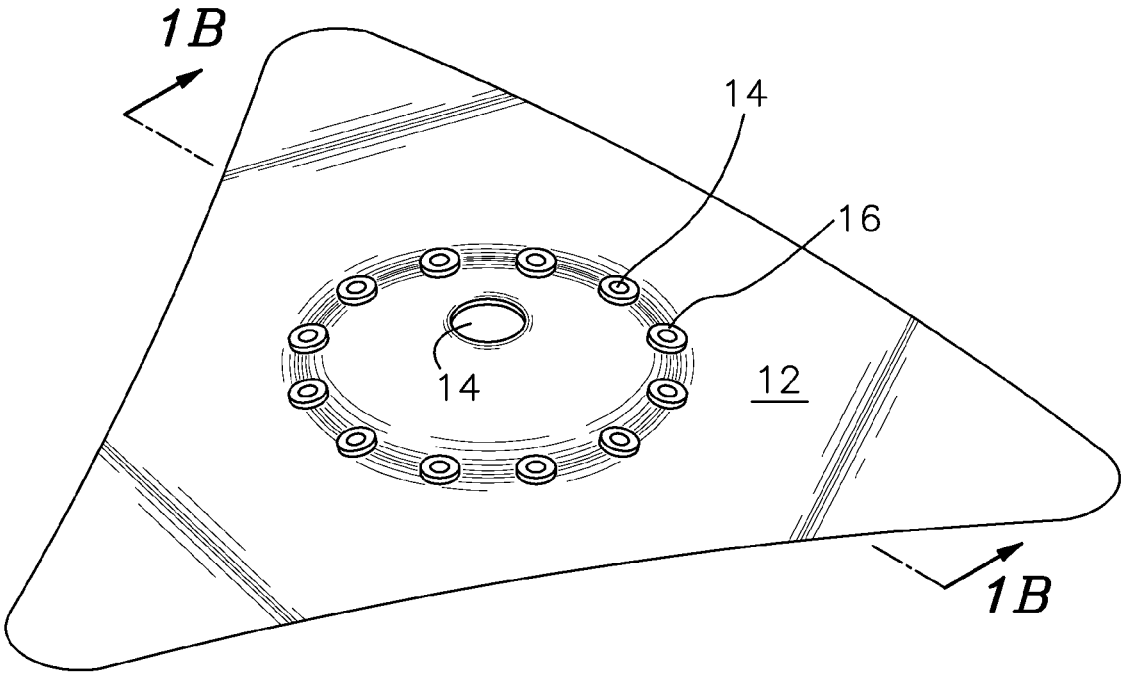
FIG. 1A is a conceptual depiction of a cymbal having one or more holes at desired locations with a thicker section of metal around an edge of said one or more holes.
Figure 1B:
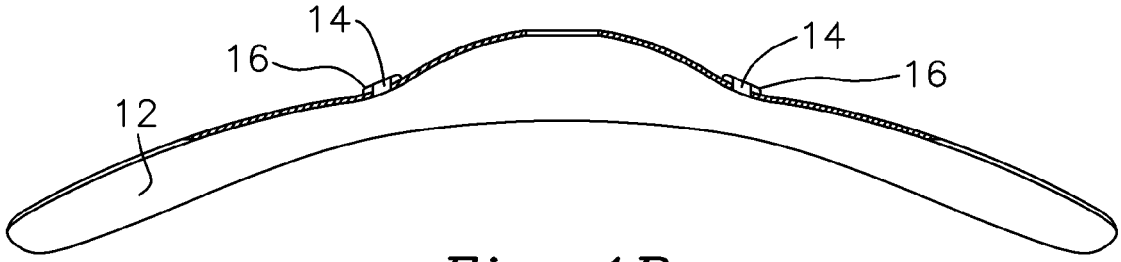
FIG. 1B is a cross-section depiction of FIG. 1A.

Referring to the drawings:

FIGS. 1A and 1B depict a cymbal 12 having one or more holes 14 at desired locations with a thicker section 16 of metal around an edge of said one or more holes 14, wherein said one or more holes 14 are created by a melting or use of friction drilling of an existing metal section at respective locations where said one or more holes 14 are desired, resulting in the thicker section 16 of metal around the edge of said one or more holes 14.

Figure 2A:
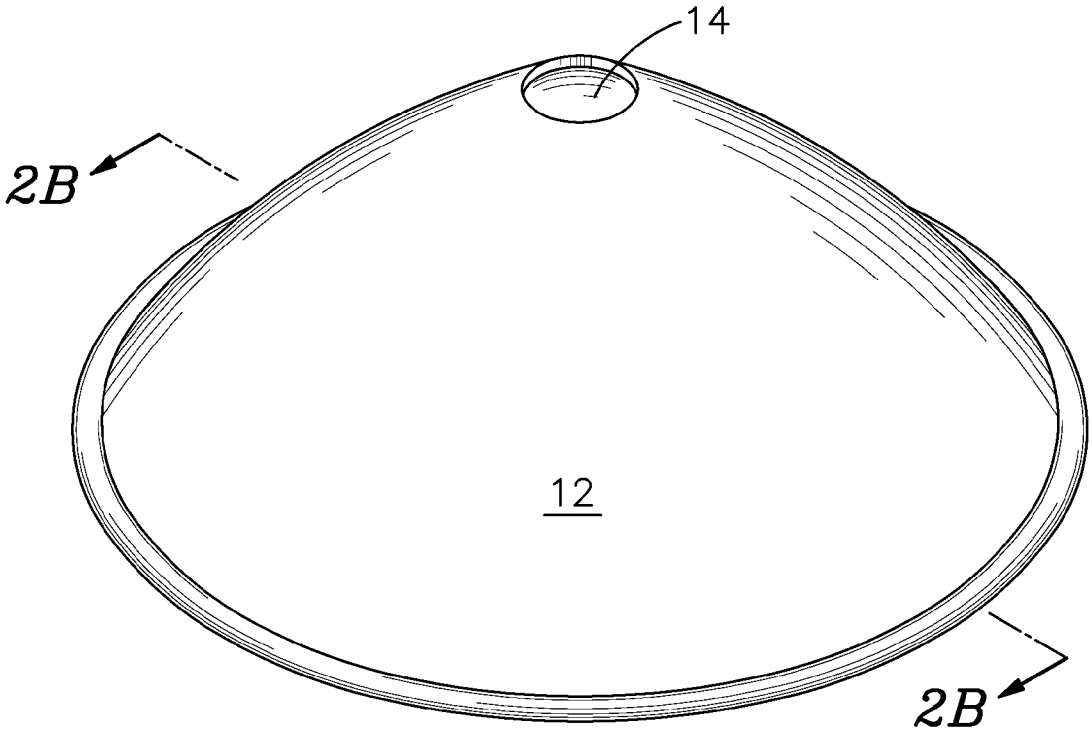
FIG. 2A is a conceptual depiction of a cymbal having a thicker metal section around said edges.
Figure 2B:
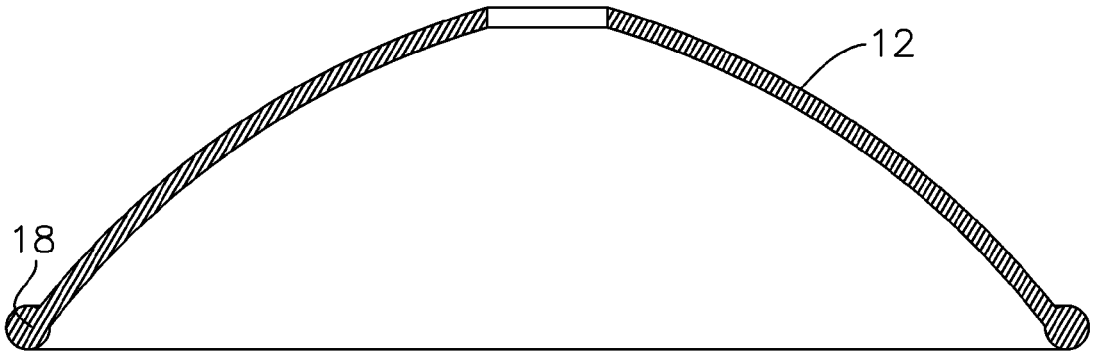
FIG. 2B is a cross-section depiction of FIG. 2A.

FIGS. 2A and 2B depict a cymbal 12 having a thicker metal section 18 around said cymbal edge, wherein said formed thickened metal edge 18 is formed by a melting process to a desired edge of said cymbal and said melting process minimizes the creation of scrap material by leaving the thicker metal section 18. Where a cymbal is also a percussion instrument that can be made from thin sheet material, this embodiment also applies to thin sheet percussion instruments.

Figure 3A:
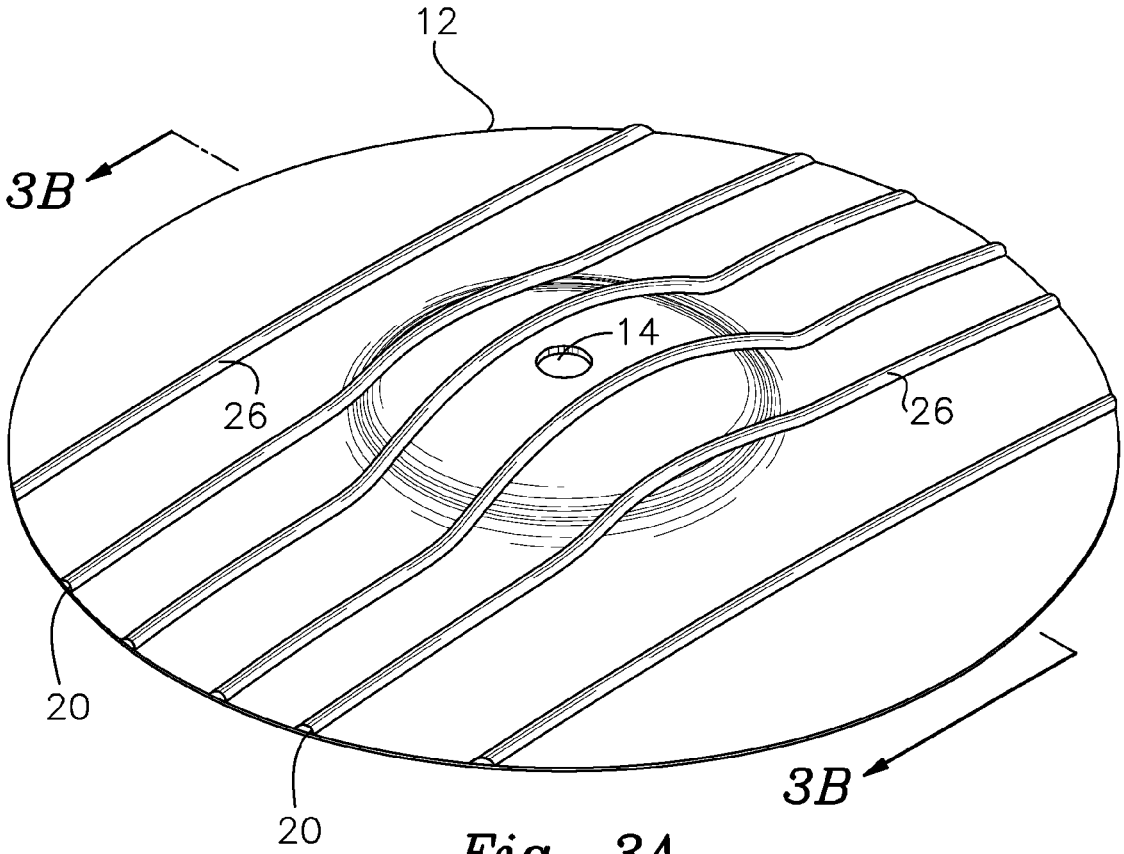
FIG. 3A is a conceptual depiction of a cymbal, wherein the cymbal is formed using a welding process in the manufacture of the cymbal, wherein material of different thicknesses and/or different alloys and hardness are joined by said welding process and FIG. 3A can also be representative of molten beads of weld material being added to one or more desired locations on a surface of the cymbal.
Figure 3B:
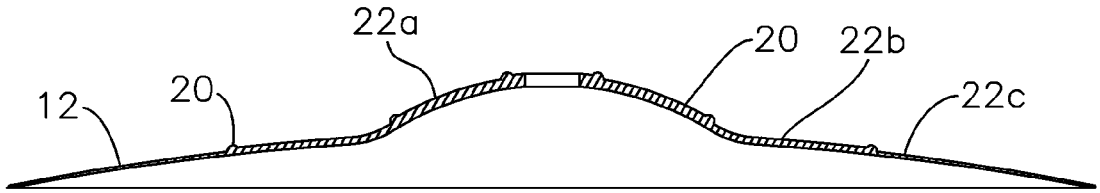
FIG. 3B is a cross-section depiction of FIG. 3A.

FIGS. 3A and 3B are representative of a conceptual depiction of a cymbal 12, wherein the cymbal 12 is formed using a welding process in the manufacture of the cymbal 12, wherein material of different thicknesses 22*a*,22*b*,22*c* and/or different alloys and hardness 24*a*,24*b*,24*c* are joined by said welding process and FIG. 3A is also be representative of molten beads 26 of weld material being added to one or more desired locations on a surface of the cymbal 12.

Figure 4A:
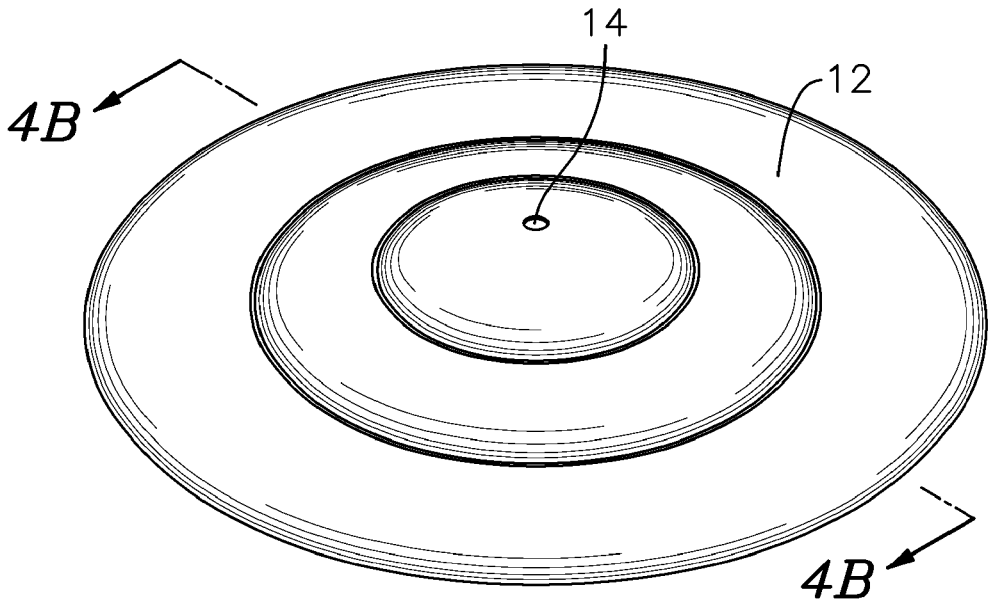
FIG. 4A is a conceptual depiction of a cymbal, wherein one or more sections of differing alloys and/or hardness are joined by said welding process.
Figure 4B:
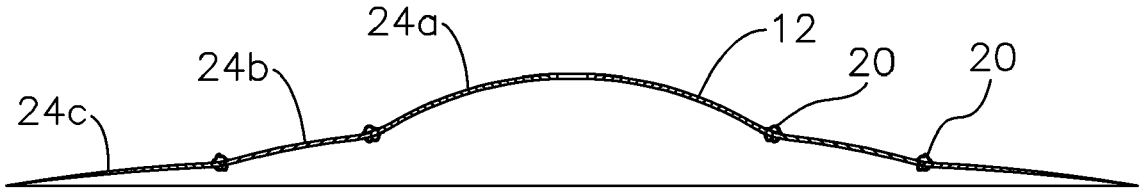
FIG. 4B is a cross-section depiction of FIG. 4A.

FIGS. 4A and 4B are representative of a conceptual depiction of a cymbal 12, wherein one or more sections of differing alloys and/or hardness 24*a*,24*b*,24*c* are joined by said welding process.

Figure 5A:
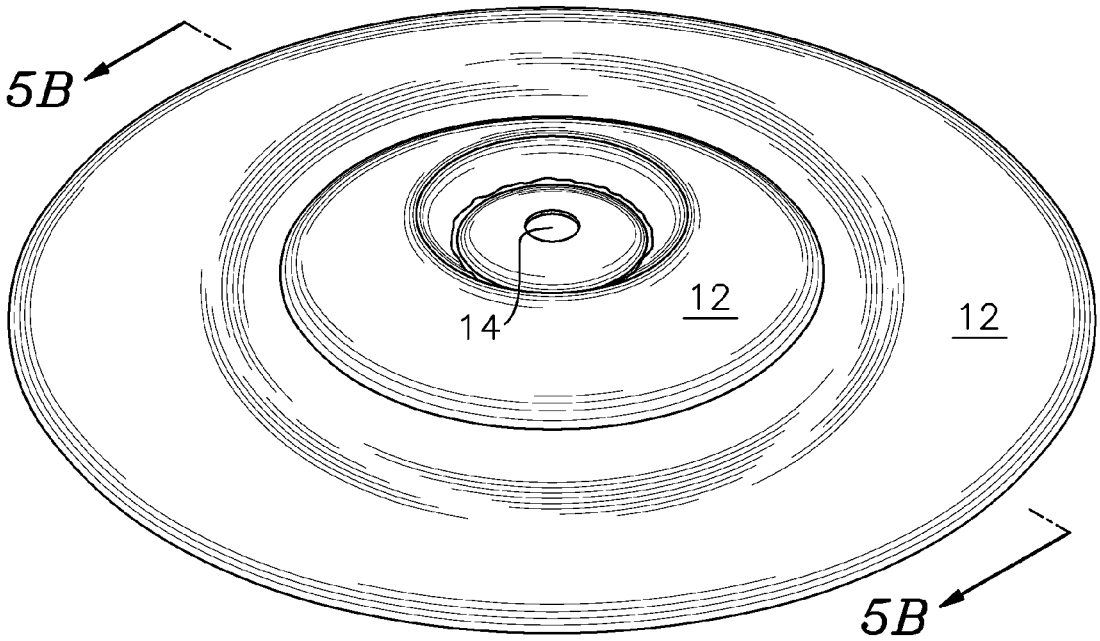
FIG. 5A is a conceptual depiction of one example of where multiple cymbals are joined by said welding process to form a compound cymbal.
Figure 5B:
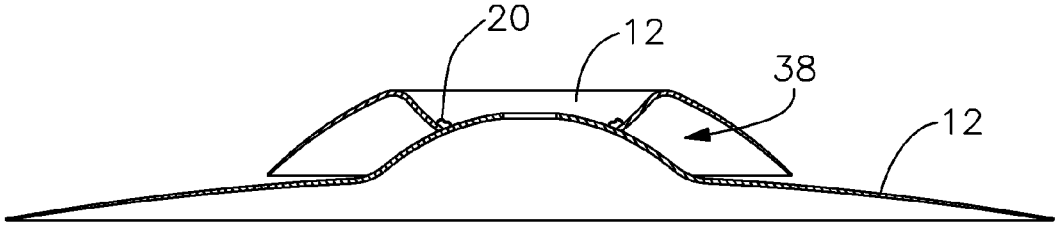
FIG. 5B is a cross-section depiction of FIG. 5A.

FIGS. 5A and 5B are representative of a conceptual depiction of one example of where multiple cymbals 12 are joined by said welding 20 process to form a compound cymbal.

Figure 6A:
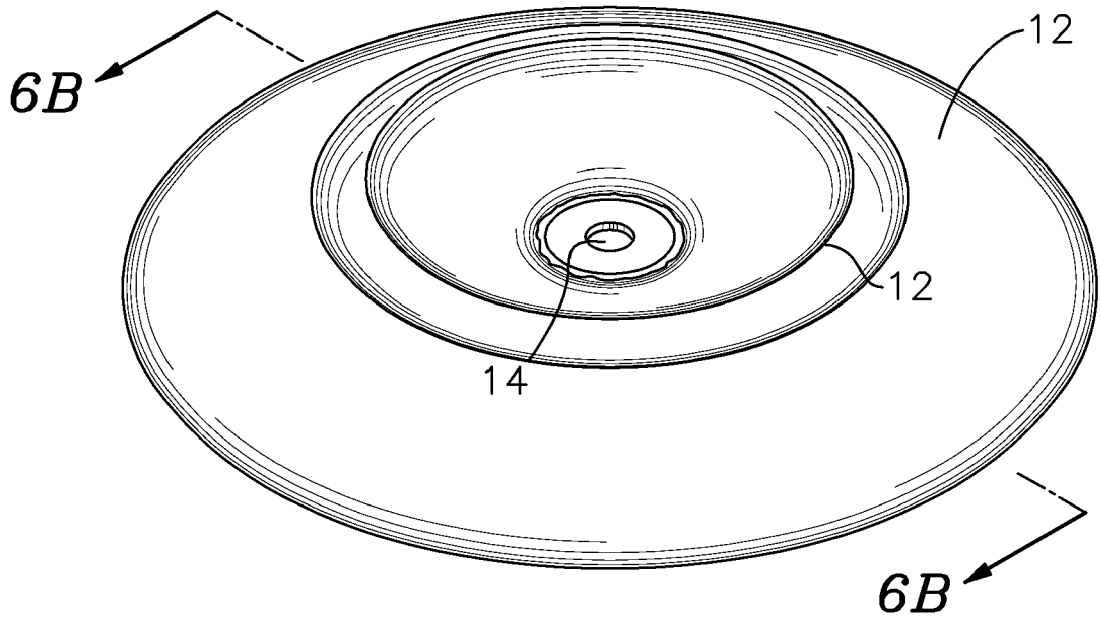
FIG. 6A is a conceptual depiction of another example of where multiple cymbals are joined by said welding process to form a compound cymbal.
Figure 6B:
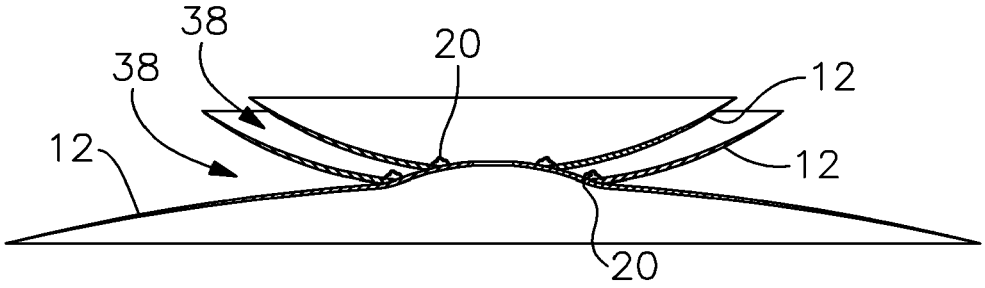
FIG. 6B is a cross-section depiction of FIG. 6A.

FIGS. 6A and 6B are representative of a conceptual depiction of another example of where multiple cymbals 12 are joined or stacked by said welding 20 process to form a compound cymbal.

Figure 7A:
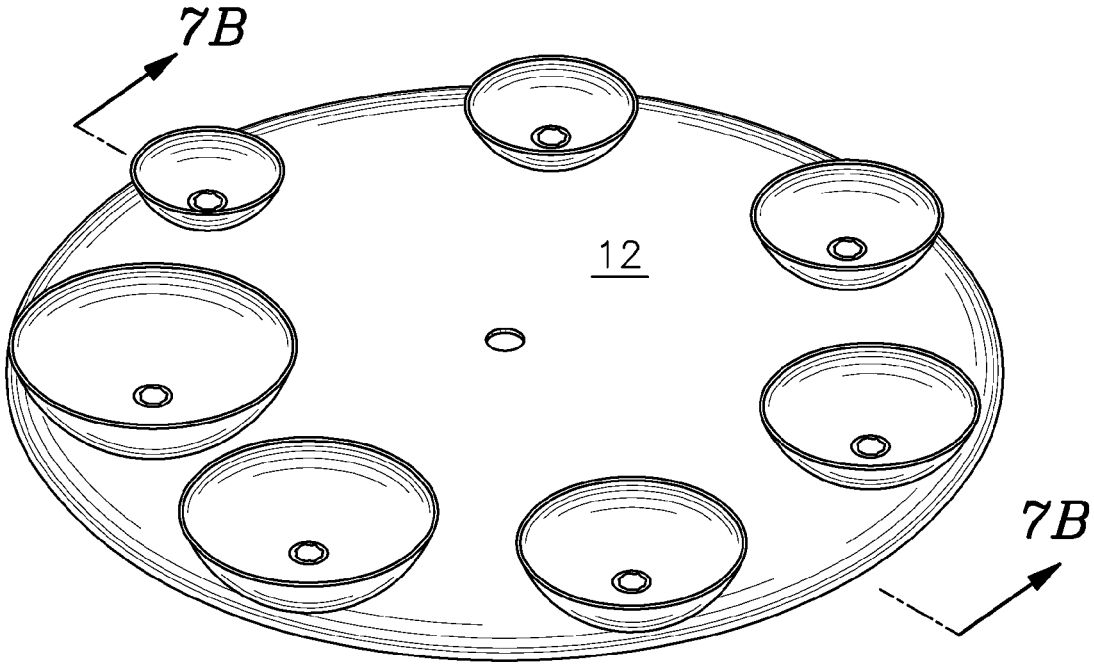
FIG. 7A is a conceptual depiction of still another example of where multiple cymbals are joined by said welding process to form a compound cymbal.
Figure 7B:
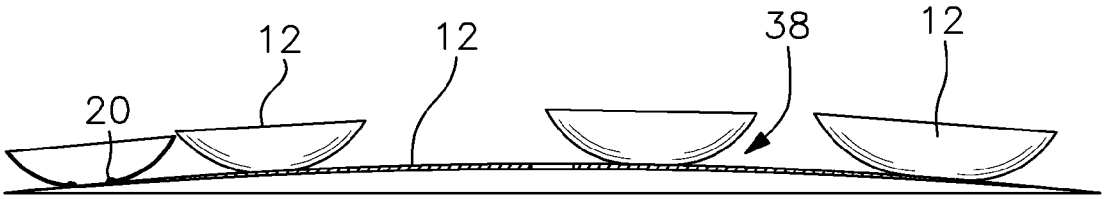
FIG. 7B is a cross-section depiction of FIG. 7A.

FIGS. 7A and 7B are representative of a conceptual depiction of still another example of where multiple cymbals 12 are joined by said welding 20 process to form a compound cymbal.

Figure 8A:
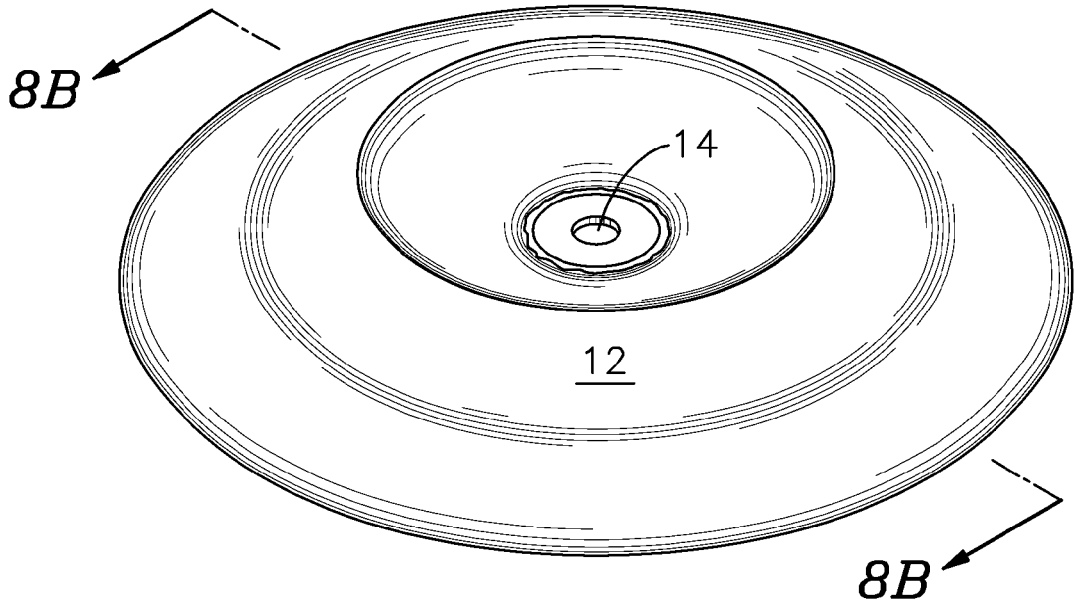
FIG. 8A is a conceptual depiction of still another example of where multiple cymbals are joined by said welding process to form a compound cymbal.
Figure 8B:
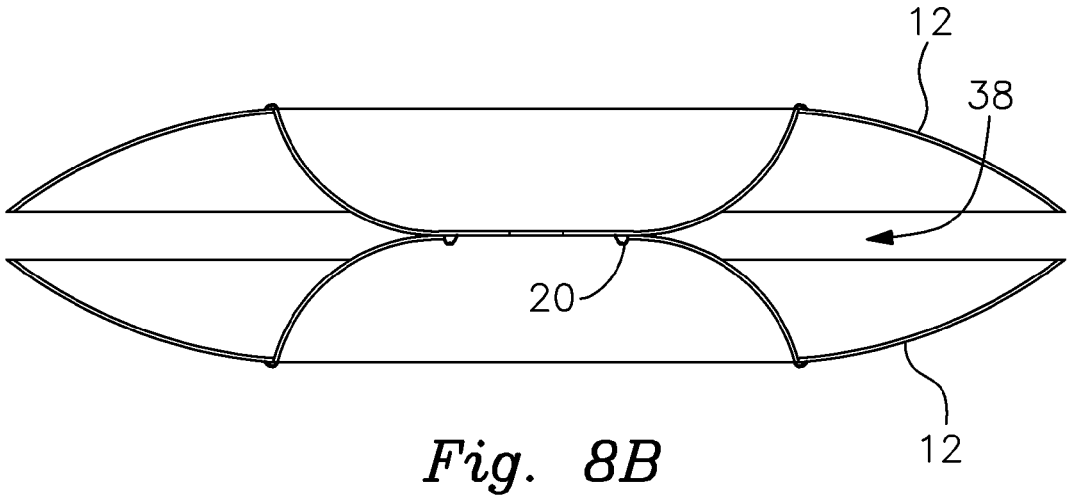
FIG. 8B is a cross-section depiction of FIG. 8A.

FIGS. 8A and 8B are representative of a conceptual depiction of still another example of where multiple cymbals 12 are joined by said welding 20 process to form a compound cymbal. For example, FIG. 8B is also representative of one example an instrument made by forming an inverted depression in the center area of each of two dome shaped sections 12 and then joining said sections together by said welding process to form a compound cymbal/bell instrument. This process can be continued by welding multiple similar made instruments in a stacked configuration.

Figure 8C:
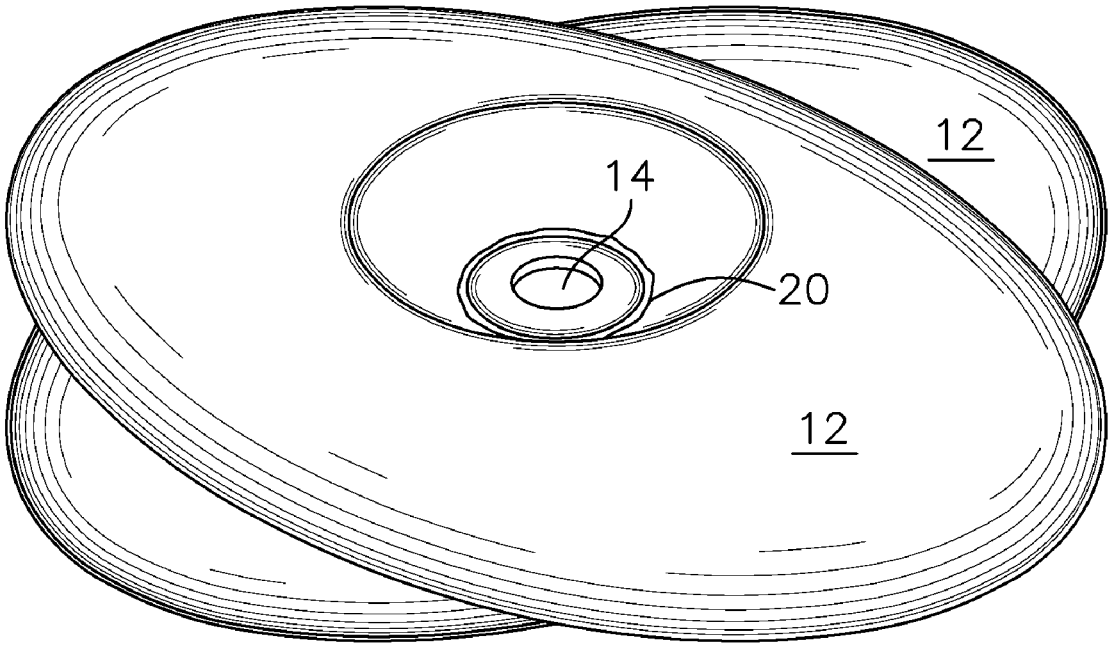
FIG. 8C is a conceptual depiction of two cymbals or bells, by way of example, two oval-shaped cymbals joined together by the welding process to form a compound percussion instrument.

FIG. 8C is a conceptual depiction of two cymbals 12, by way of example, two oval-shaped cymbals, joined together by the welding process to form a compound percussion instrument. The actual shape of the cymbals can be varied as desired to achieve the sound desired, such as oval shapes, polygonal shapes, round shapes and combinations thereof.

Figure 9A:
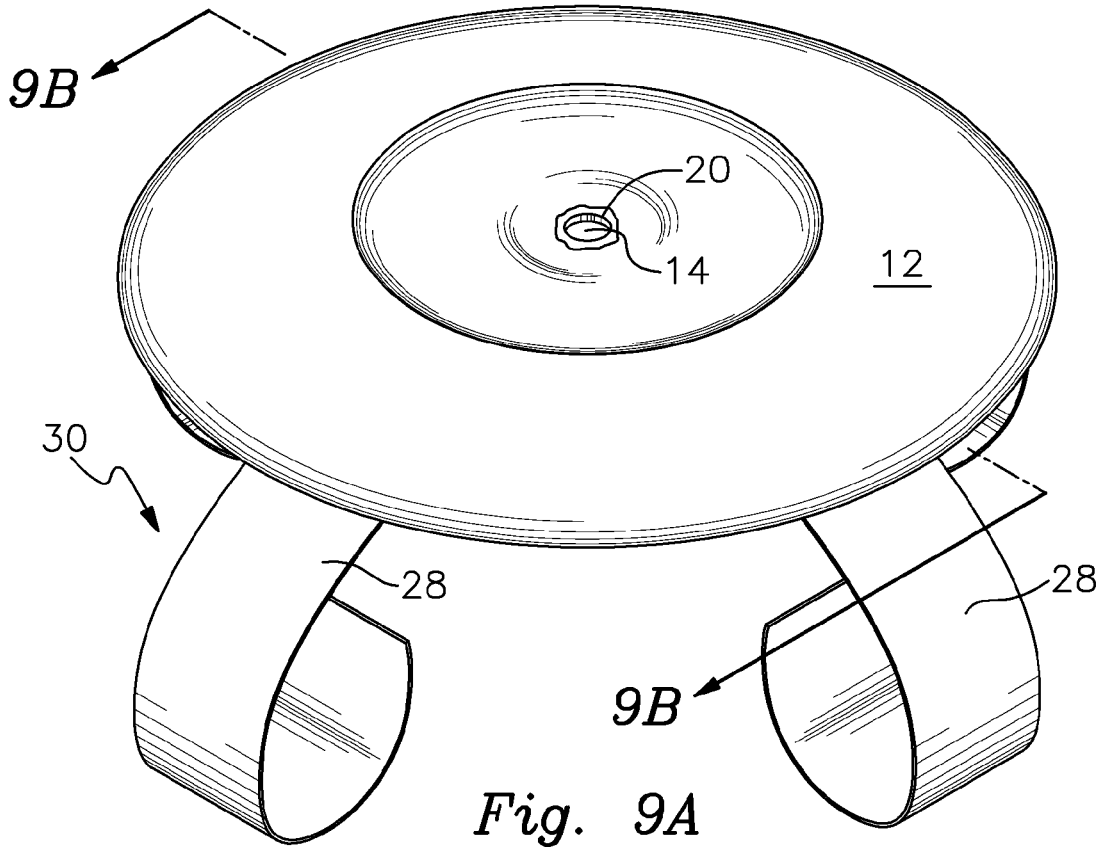
FIG. 9A is a conceptual depiction of a cymbal, wherein other objects such as a thin sheet instrument are joined to the main section welding process.
Figure 9B:
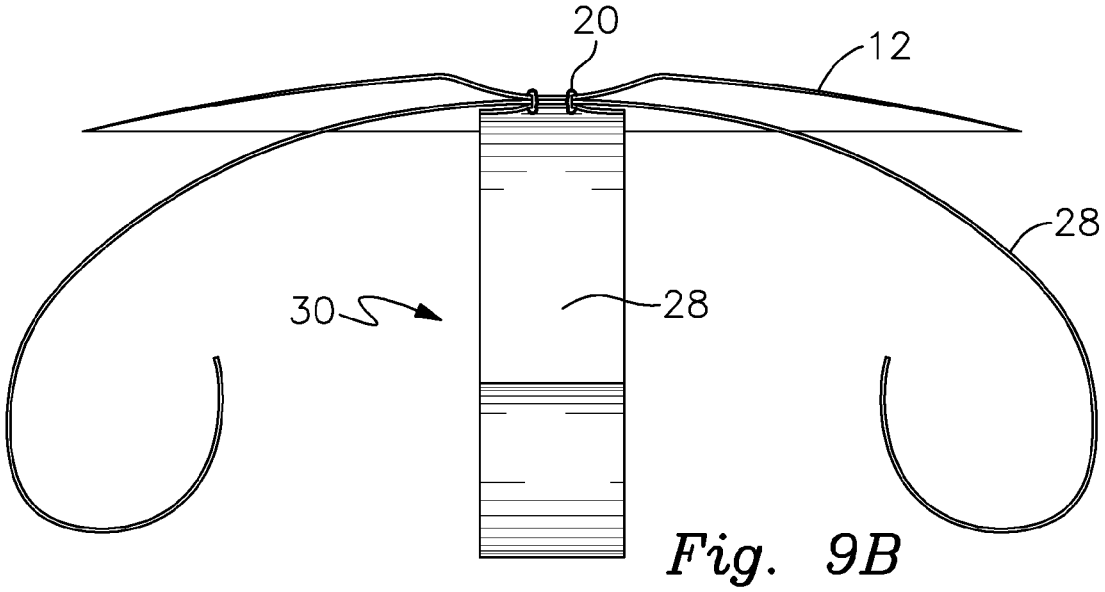
FIG. 9B is a cross-section depiction of FIG. 9A.

FIGS. 9A and 9B are representative of a conceptual depiction of a cymbal 12, wherein other objects 28 such as a thin sheet instrument 30 are joined to the main section using said welding 20 process.

Figure 10A:
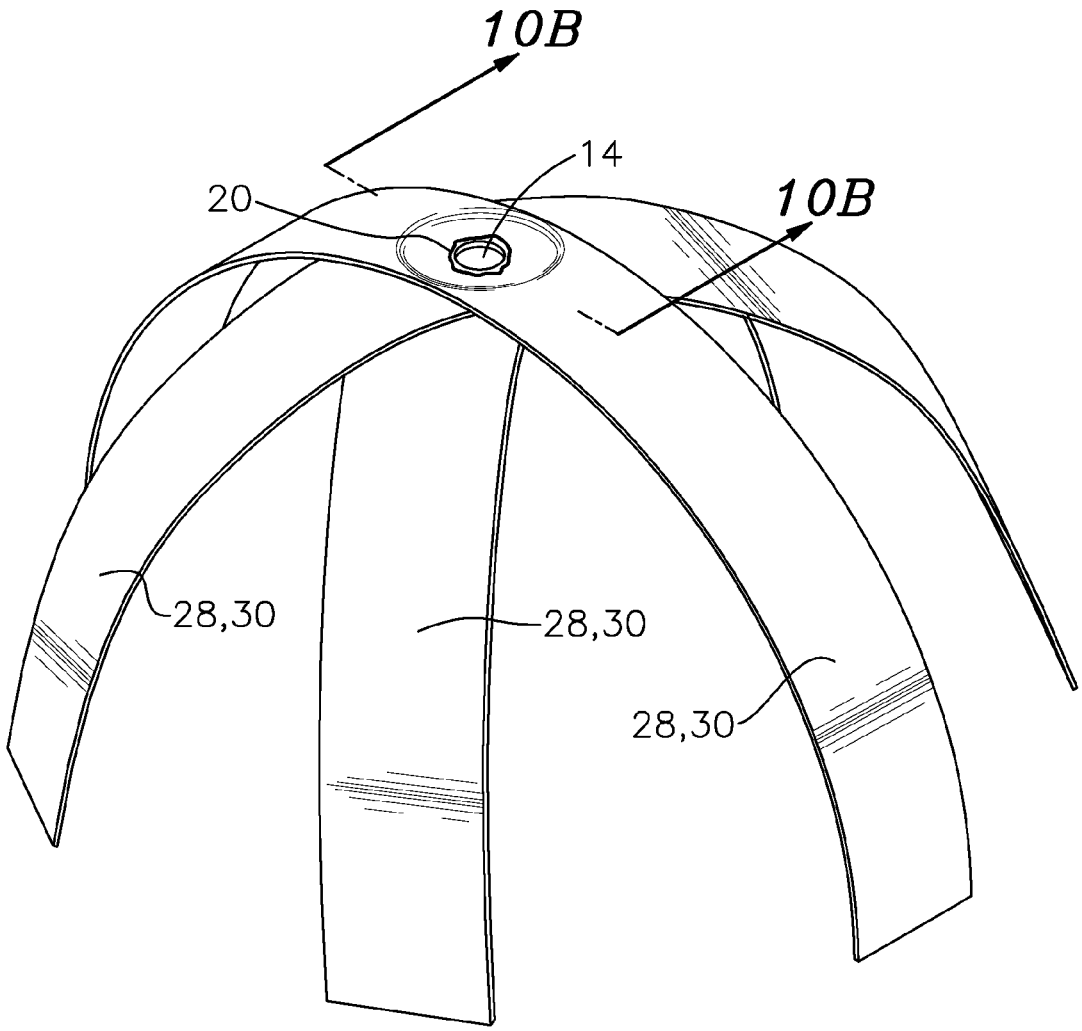
FIG. 10A is a conceptual depiction of a thin sheet instrument, wherein multiple thin sheet instruments or objects are joined by said welding process to form a compound instrument.
Figure 10B:
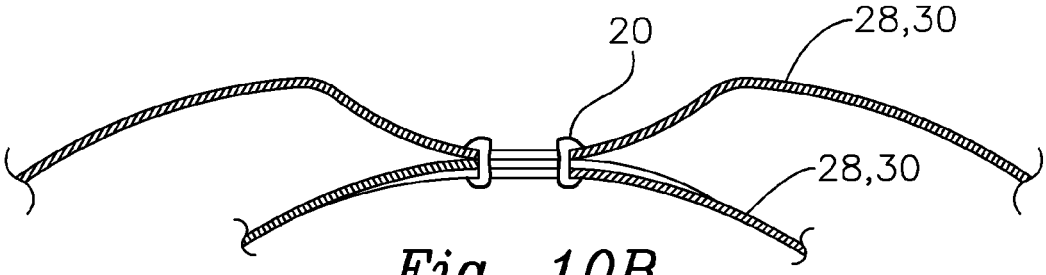
FIG. 10B is a cross-section depiction of FIG. 10A.

FIGS. 10A and 10B are representative of a conceptual depiction of a thin sheet instrument 30, wherein multiple thin sheet instruments 30 or objects 28 are joined by said welding 20 process to form a compound instrument.

The following depictions are of sheet instruments 30 which are typically made from generally flat thin sheet material.

Figure 11A:
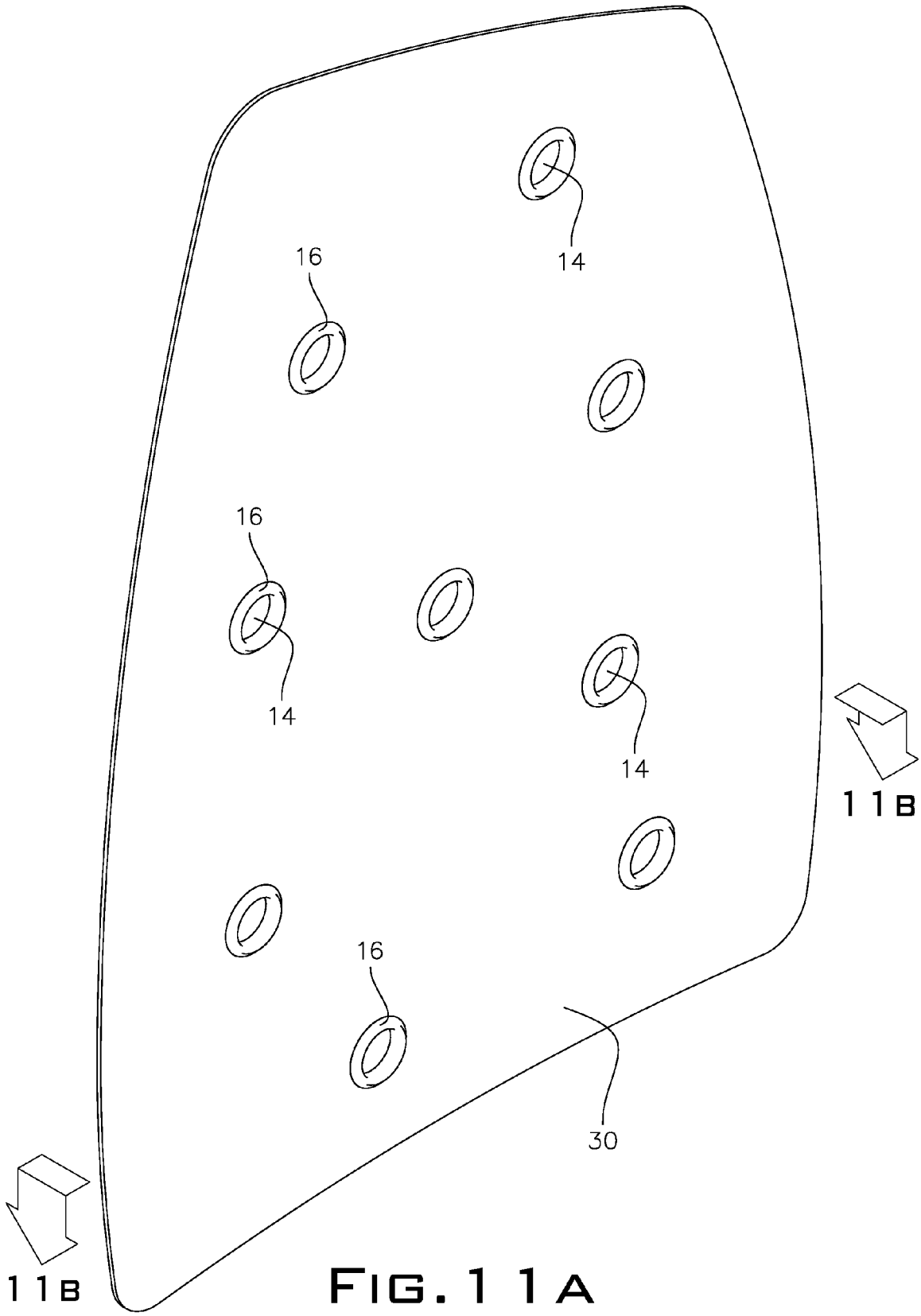
FIG. 11A is a conceptual depiction of a thin sheet instrument having one or more holes at desired locations with a thicker section of metal around an edge of said one or more holes.
Figure 11B:
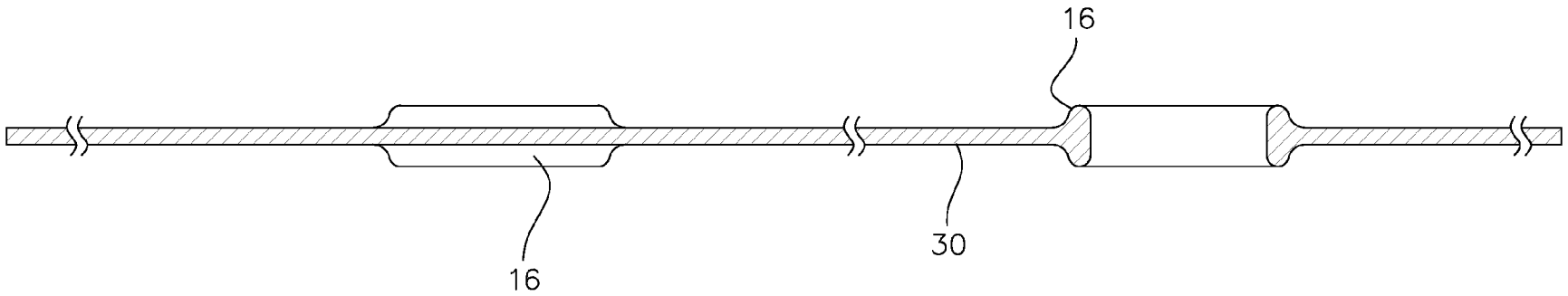
FIG. 11B is a cross-section depiction of FIG. 11A.

FIGS. 11A and 11B depict a thin sheet instrument 30 having one or more holes 14 at desired locations with a thicker section of metal around an edge 16 of said one or more holes 14, wherein said one or more holes 14 are created by a melting of an existing metal section or use of friction drilling at respective locations where said one or more holes 14 are desired, resulting in the thicker section of metal around the edge 16 of said one or more holes 14.

A thin sheet instrument 30 can also have edges at desired locations with a thicker metal section around the edges. The thickened metal edge in this case can be formed by melting a desired edge of the thin sheet instrument 30 and the melting process minimizes the creation of scrap material by leaving the thicker metal section.

Figure 12:
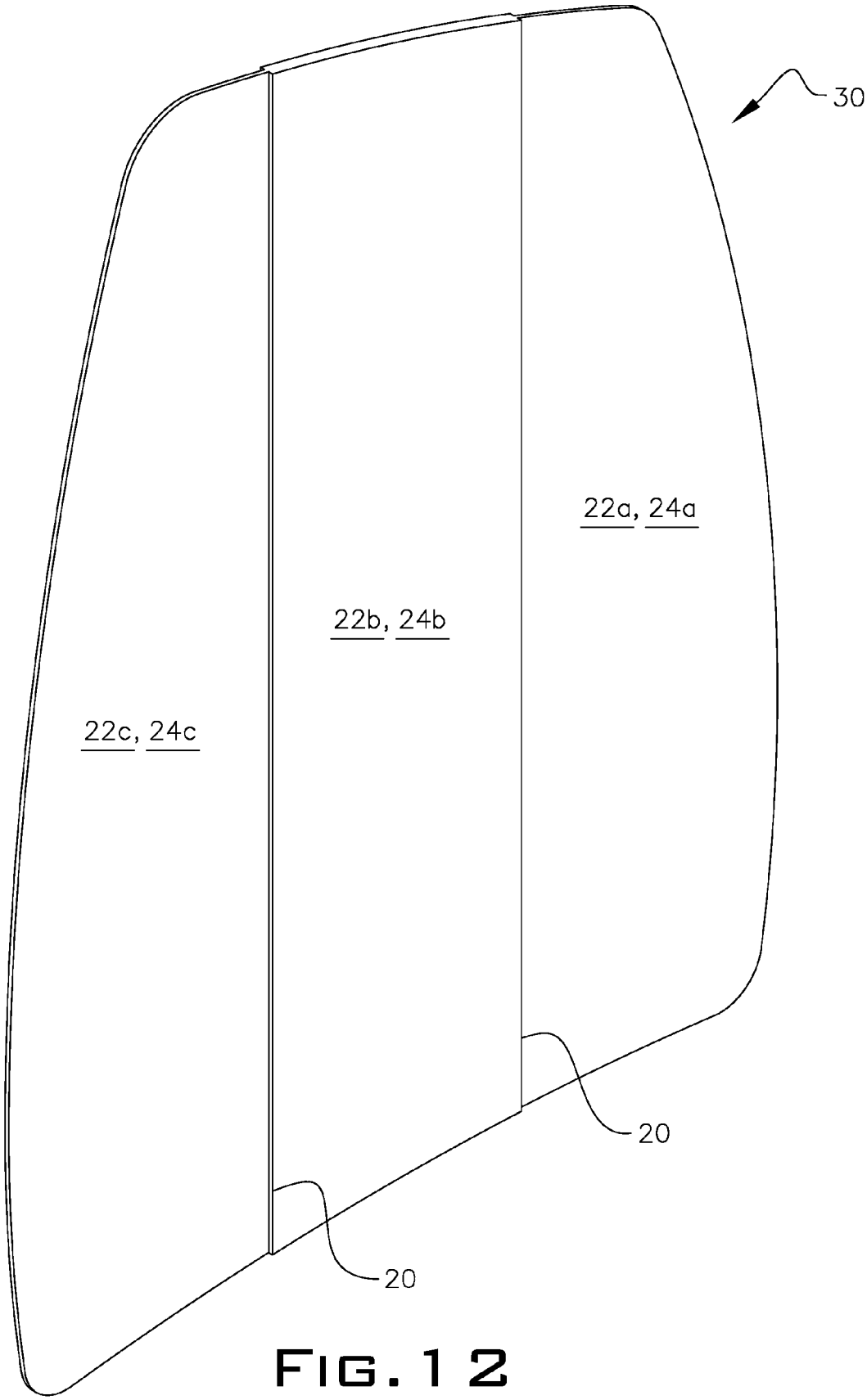
FIG. 12 is a conceptual depiction of a thin sheet instrument wherein said instrument is formed using a welding process in the manufacture of the instrument and/or alternatively, wherein one or more sections of differing alloys are joined by said welding process, and/or alternatively wherein one or more sections of differing hardness are joined by said welding process, and/or alternatively wherein one or more sections of differing thickness are joined by said welding process.

FIG. 12 depicts a thin sheet instrument 30 wherein the instrument is formed using a welding process in the manufacture of the instrument (see weld joint 20). This drawing is also representative of an instrument 30 that can be made where one or more sections of differing alloys or hardness 24*a*,24*b*,24*c* being joined by the welding process, where one or more sections of differing thicknesses 22*a*,22*b*,22*c* are joined by the welding process.

Figure 13A:
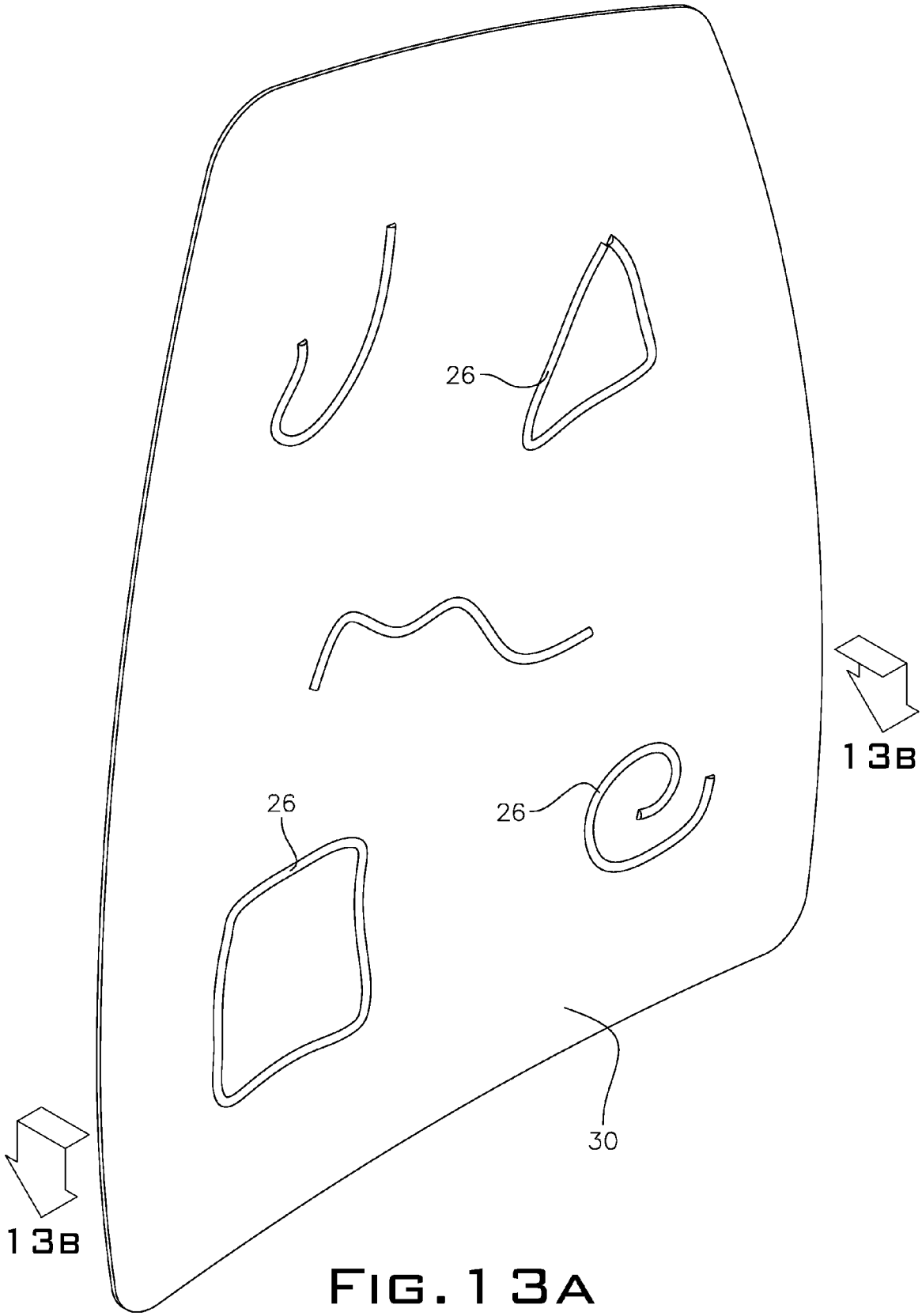
FIG. 13A is a conceptual depiction of a thin sheet instrument, wherein a molten bead or section of metal is added to one more desired locations on a surface of the instrument.
Figure 13B:
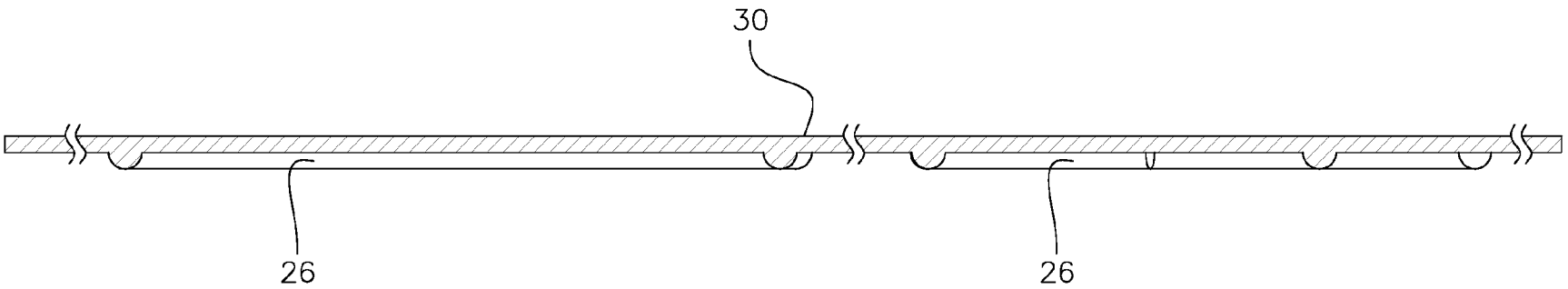
FIG. 13B is a cross-section depiction of FIG. 13A.
Figure 13C:
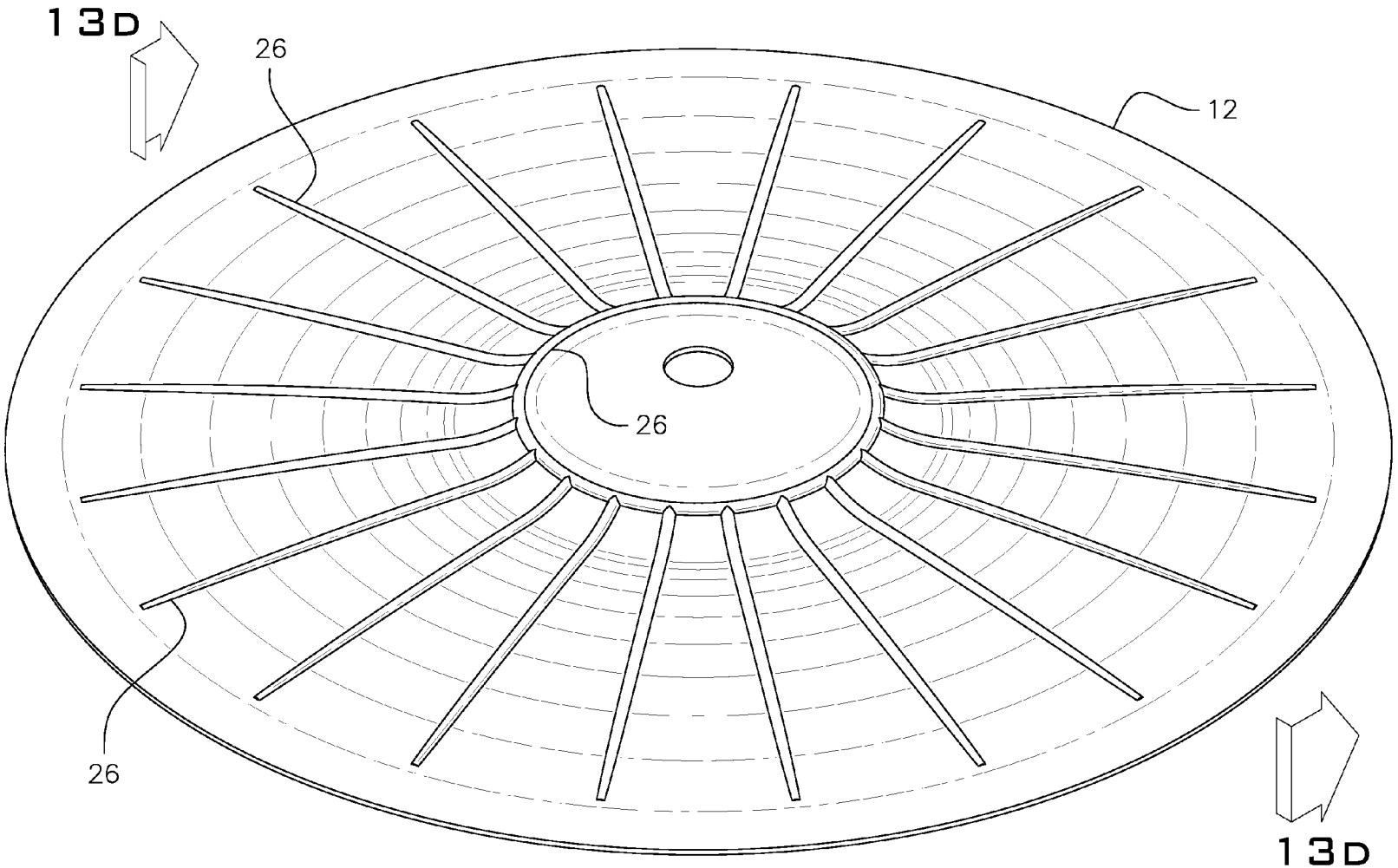
FIG. 13C is a conceptual depiction of a percussion instrument in the form of a cymbal where a molten weld bead or section of metal has been applied in a desired pattern, in this example, in a radial pattern, with the bead being progressively thinner toward the outer edge.
Figure 13D:
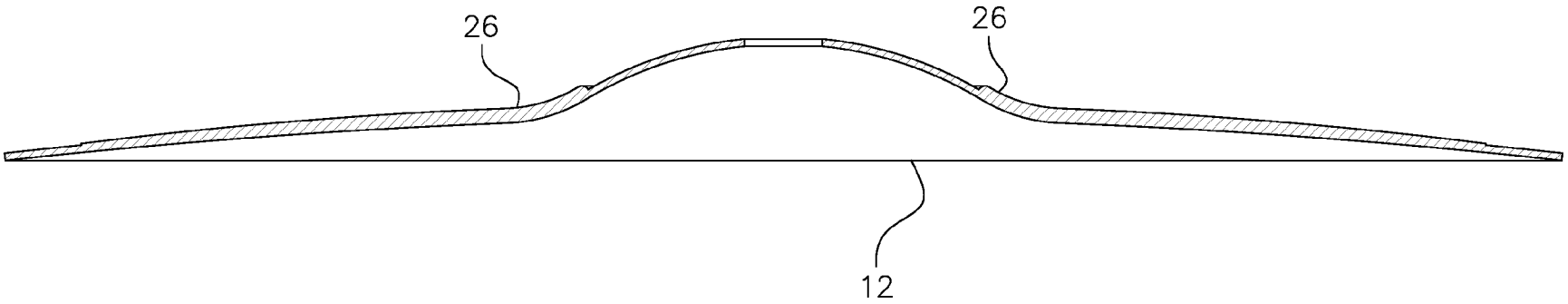
FIG. 13D is a cross-section depiction of the instrument of FIG. 13C.
Figure 13E:
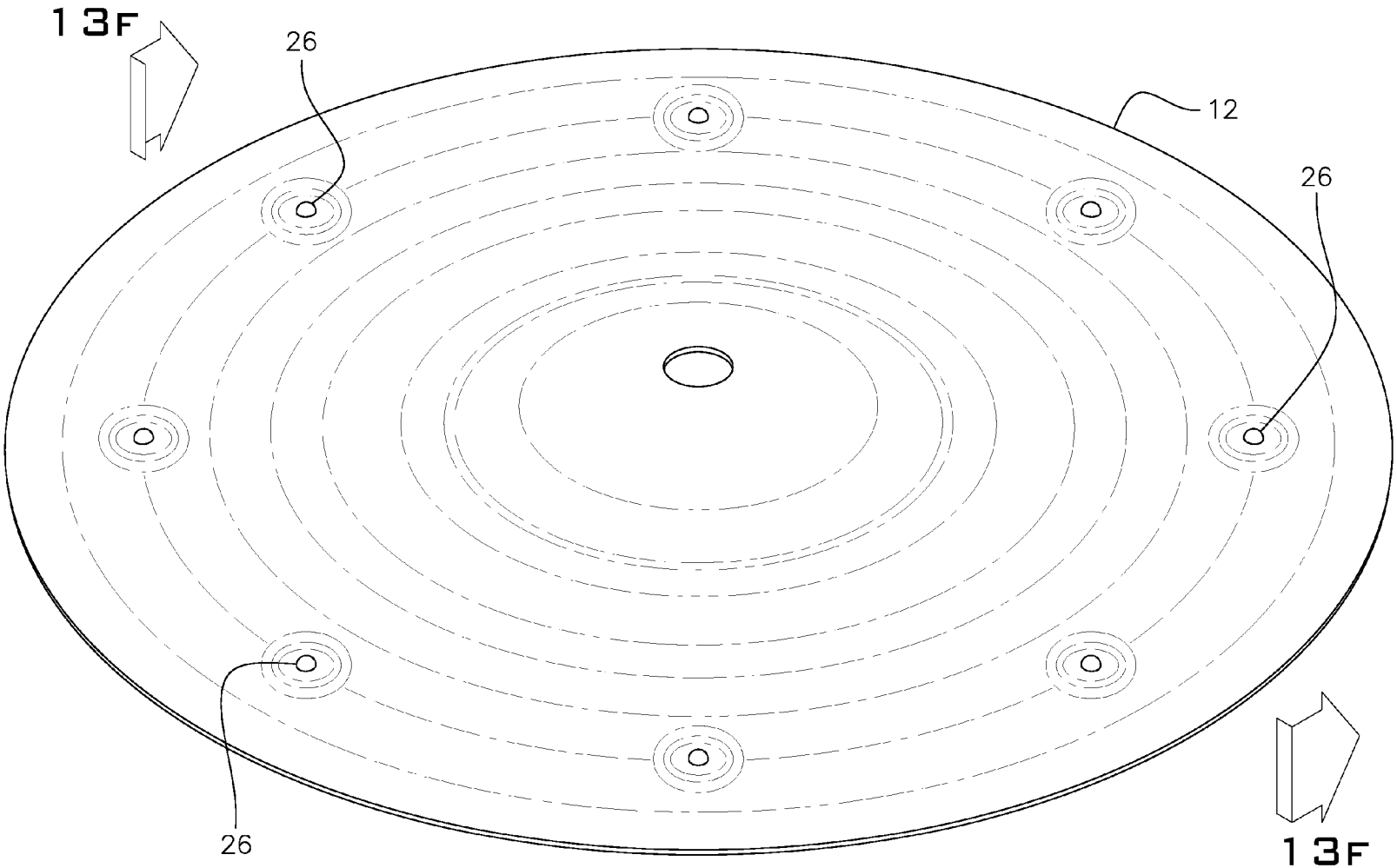
FIG. 13E is a conceptual depiction of a cymbal, wherein a molten bead or section of metal is added to one more desired locations on a surface of the instrument.
Figure 13F:
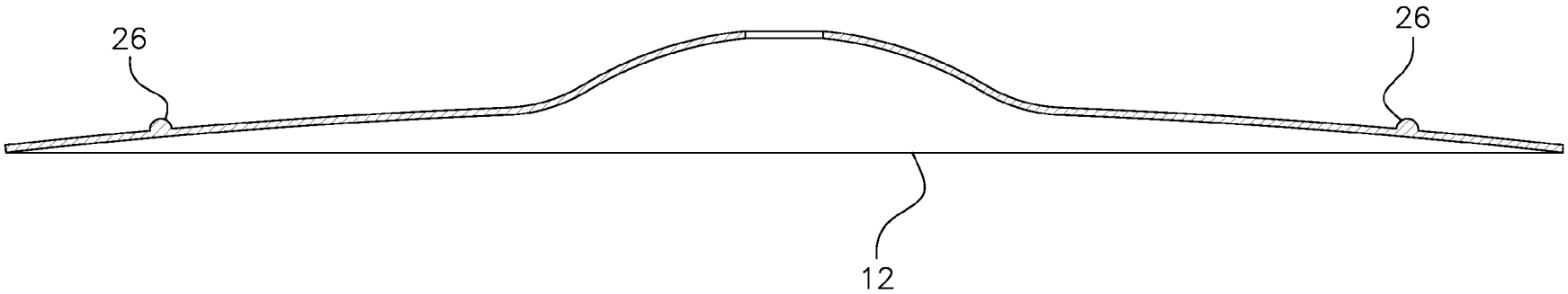
FIG. 13F is a cross-section depiction of FIG. 13E.

FIGS. 13A and 13B depict a thin sheet instrument 30 made by a welding process, where a molten bead or section of metal 26 is added to one more desired locations on a surface of the instrument 30. FIGS. 13C and 13D depict conceptually a percussion instrument 12 in the form of a cymbal where a molten weld bead or section of metal 26 has been applied in a desired pattern, in the example a radial pattern, with the bead or metal 26 is progressively thinner toward the outer edge, in this case thicker toward the center and thinner toward the perimeter. FIGS. 13E and 13F depict conceptually a cymbal 12, wherein a molten bead or section of metal 26 is added to one more desired locations on a surface of the instrument 12.

Figure 14A:
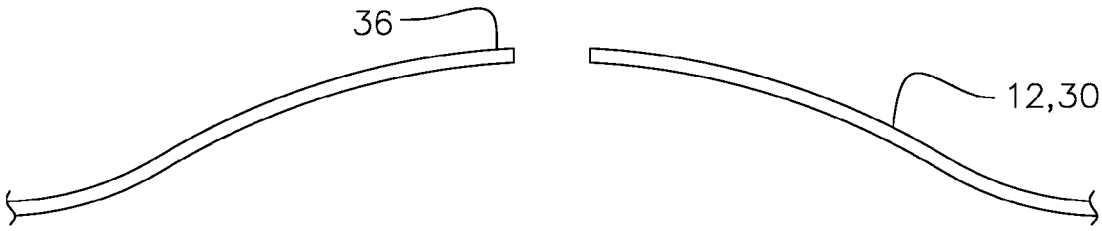
FIG. 14A depicts a hole in portion of a percussion instrument.
Figure 14B:
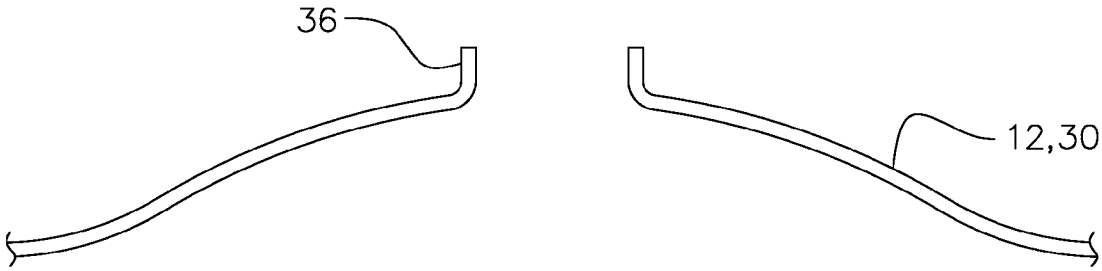
FIG. 14B depicts the hole of FIG. 14A after it has been initially flared.
Figure 14C:
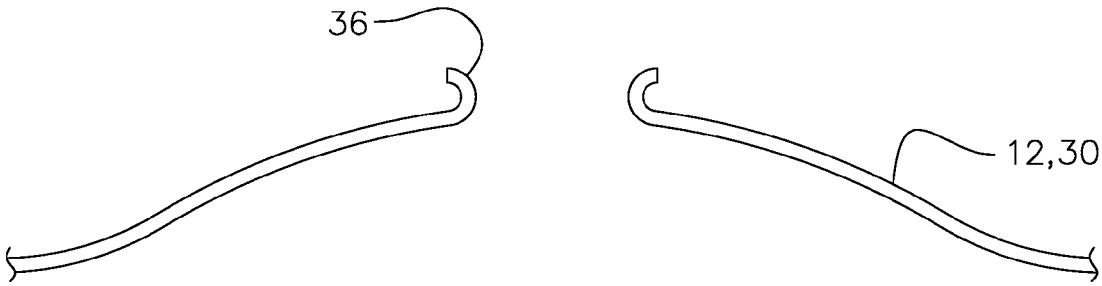
FIG. 14C depicts the final flaring stage where the material along the hole has been coiled or curved back to form a smooth interior edge.

FIGS. 14A-14C depict a hole in portion of a percussion instrument, which can be a cymbal 12 or a thin sheet percussion instrument 30, wherein the inside edge 36 is initially flared; and then coiled or curved back to form a smooth interior edge 36.

Multiple Stacked Compound Bells and Cymbals

The aforementioned compound instruments depicted above can be stacked upon each other by means of a common center bolt or post to form a rattling instrument capable of considerably high amplitude.

Compound bells and cymbals can also be placed upon or affixed to soft or semi-soft surfaces or radiating devices such as foam or wood to yield a novel sound quality.

Tuned Multiple Compound Bells

Multiple bells can be tuned to different notes within a pair which is welded together. For example, the top section could be tuned to a different note than the bottom. While the difference in frequency between the sections can be as random if desired, precise tuning to any scale system is possible. This system is effective in round or geometrically shaped embodiments.

Compound Bells and Cymbals with Minimal or No Common Resonating Air Cavities (see for example, the space which defines the cavities between the cymbals/bells in FIGS. 5-8, especially the air cavity 38 depicted in FIG. 8B).

In these embodiments, two or more instruments are welded together or one or more sections of metal are welded together to create the instrument. For example, some sections may be a simple domed curve with no secondary curves. Sections with multiple or complex curves within each section can also be utilized. In some embodiments, the upper sections are curved in a direction which is opposite that of the larger, lower section. In some embodiments, the upper sections are curved in a direction. In some embodiments, the upper sections are curved in a direction which is the same as that of the lower section.

As the sections progress toward center, each is of reduced size or diameter. Geometric shapes such as square instrument shapes or round shapes can be utilized.

In most embodiments, an unexpected result of the addition of one or more upward curved cups is a substantial increase in amplitude when compared to conventional cymbals of similar weight. This is useful in saving valuable material cost as an instrument of a given loudness can be now made from less mass of material.

In the round embodiment, the one or more center sections seem to serve a similar vibrational function to that of the center "cup" found in traditional turkish style cymbals, yet the instrument vibrates in ways sufficiently different than traditional cymbals as to form a novel sounding instrument. One important distinction between this embodiment and conventional cymbals is that the sections of this embodiment vibrate both independently and with shared vibration.

One benefit of this embodiment is that the center section or sections can of considerably differing gauge or thickness versus the main underlying section. The effect called "tapering" in conventional cymbals, which increases swell and adds complexity to overtone structure, is achieved by lathing the cymbal progressively deeper toward the outer edge of the cymbal, thus removing material and creating a cymbal with an outer edge which is thinner than its center. This invention allows for a more dramatic change in gauge without wasting valuable material through material removed processes such as lathing.

Another benefit is the richly complex overtone structure realized in this embodiment. When compared to conventional cymbals of similar size, this embodiment is capable of producing a louder and more complex series of midrange overtones, as well as a hum note of lower frequency and lower amplitude. The hum-note in cymbals can often be intrusive as it produces an isolated and defined "note" or frequency. It is therefore often desirable for a cymbal to either feature a hum note of low frequency and low amplitude, or a series of richly complex multiple hum notes.

While this embodiment can produce a series of sounds which resemble conventional cymbals in some ways, it can perform several innovative functions. One such function is the relative independence with which the center welded cup can ring. If the musician strikes the instrument and then dampens the outer edge of the instrument by touching or grabbing the edge in a way which would silence a conventional cymbal, the cup in this embodiment can still continue to vibrate with a bell-like tone.

This is a useful musical effect when desired. If the musician desires a complete cessation of sound upon damping, the musician can simply grab or touch both the cup and the outer edge at the same time.

The center welded cup or "bell" can also be shaped in a form which creates a common resonating air cavity 38, which is the spacing created by the welded configuration.

Such an embodiment can yield a center bell of markedly independent vibration. The said center bell also conducts vibration throughout the instrument in a manner which yields a novel sound, as well as a substantial increase in overall amplitude. Such an embodiment of a given weight is capable of producing a sound of overall loudness which is equal to or greater than conventional instruments of similar mass or weight.

The welded center cup can also be used as a handle to hold two such cymbals to allow the cymbals to be "crashed" together in a manner similar to that used with orchestral crash cymbals.

The size or diameter of the ring-shaped weld area in all such embodiments influences the independence of the vibrating sections. A small weld area which is closer to the center node area will result in more independent vibration. A weld area which extends outward farther from the center node area will result in less independent and a more shared vibration which seems to be a vibrational composite of the sections.

Multiple Bells and Cymbals Welded to a Common Base

The welding of bells or cymbals to a common base can result in increased loudness or amplitude and shared vibration among the various vibration bells or cymbals, as well as an alteration of overtone structure. The base can be a variety of shapes, including but not limited to, a circular disc or plate. Said plate can also be struck to vibrate. Said base can also feature a center hole to facilitate mounting on a cymbal stand or other mounting system. The base can also be made of a different alloy than the bells or cymbals which are welded to it. If the bells were made of bronze for maximum brilliance of high frequency overtones, said base could possibly be made of a different alloy such as steel. A process called "brazing" could be used to join the differing alloys. The use of steel in the more massive member could result in a cost savings.

When an individual bell or cymbal is struck in this embodiment, its vibrations conduct into the other areas of the instrument, causing those areas to vibrate in a manner which adds richness or complexity to the overall sound. The section struck and the adjacent sections act upon each other during vibration in complex ways which are virtually impossible to completely quantify. Said bells or cymbals can be arranged in any order or orientation. One example is to mount small bells in a circular arrangement around the outer area of a disc or dome. Said bells can be of many sizes. Small diameter bells and thicker bells will vibrate at higher frequencies. Bells which are tuned to specific frequencies can also be welded to a common base in an arrangement which resembles that of a piano keyboard. In such an arrangement, when tuned to a conventional western musical scale, the notes corresponding to the white keys of a piano, also known as "naturals" would be arranged in a continuous straight or curved line, while the notes corresponding to the black keys, known as "sharps and flats" would be mounted in back of the first row in an arrangement corresponding to their position on a piano keyboard. This is convenient for percussionists, as several other instruments such as marimbas and xylophones are arranged in such a fashion.

In cases where bells or cymbals are welded to a common base, a hole can be created in the ringing bell (or cymbal) member followed by a weld process called plug welding, whereby the bell is placed on the base and the hole is filled by the welder, thus fusing the bell to the surface. The hole can also be placed in the base and welded from the underside.

Benefits of these embodiments which can be realized are:

The increased ease of forming specific members through the use of two or more different alloys.

Increased ease of forming, overtone complexity, amplitude, pleasing visual appearance, and strength through various combinations of the use of two or more different alloys, heat affected zones, hammer patterns, shapes, tapers, bows, decorative finishes or patinas, and/or diameters of added vibrating members.

The use of multiple thickness sections which enhance the complexity of overtones without the waste of lathing or material removal.

Substantial increases in overall amplitude compared to conventional instruments of similar total weight.

Suspension Holes with Flared Outer Edges

The use of flared holes (as seen in FIG. 14C) aid to a great degree in reducing wear to the instrument, as well as wear to the rigid bolt of a cymbal stand. When the instrument is suspended from a rigid member such as a cymbal stand, flaring the mounting hole greatly reduces wear to the soft sleeve on the mounting bolt of a cymbal stand. The sharp edge of a conventional hole seen in traditional cymbals would quickly wear out the soft sleeve and the steel bolt of the stand would then begin to exert force on the hole in the instrument causing wear or cracking.

In welded cymbal and bell embodiments, the center area can become softened or annealed by welding. This can weaken the center area. By flaring said holes, into the stronger shape depicted, the hole can now retain sufficient strength for the invention.

To flare the mounting hole, a small hole is first created. This hole can then be formed in a process called swaging, whereby the hole is expanded in diameter with the remaining material pushed down and outward, to form a shape similar to a trumpet bell. This process can increase the surface area and strength of the hole. The flared shape, with its continuous bell shaped curve prevents abrasive friction from wearing down the cymbal stand rubber or plastic sleeve.

Nickel-Iron Grain Refiners in Percussion Instruments Using Molten or Plasticized Metal Ductility and strength are necessary to form the shapes in this invention. In many alloys, the metal is quite ductile (easily deformed without cracking or failure) when in the soft or partially softened state. These softer states of metal, while quite ductile, are not as strong as the hardened levels of temper in any given alloy.

Temper ratings of certain alloys, especially those which are strengthened through cold work methods such as rolling, hammering or other methods which can reduce the thickness of said metal and reduce grain size and elongate the grain structure of the alloy, are rated by the percent of elongation remaining in the alloy before the metal will fail in tension.

Phosphor bronze is hardened and strengthened by cold work. Phosphor bronze alloys are typically composed of copper, tin and a small amount of phosphorous. A typical phosphor bronze, when hardened to a strength rating of extra spring temper, can only be elongated by an additional 2% before failing and breaking or cracking in tension.

The addition of small amounts of iron and nickel can refine and reduce grain size and hence, increase strength. Through the addition of said iron and nickel, ideally in ranges of between 0.05 to 0.20% each, can increase strength considerably. By utilizing these grain refiners, a temper with more elongation remaining in the alloy can be used.

A temper rating of extra hard in such an alloy, will possess strength equal to extra spring in a typical bronze alloy. This extra hard temper can be elongated considerably more than extra spring temper hence allowing the deformation needed to easily form this invention.

When phosphor/tin bronzes are welded, the weld area can become softened or annealed due to the heat of the weld process. This can weaken the weld area. By using nickel-iron grain refiners, the weld area can still remain, due to the added strength of said refiners, at a level of strength needed for this invention.

In short, the softer and more ductile temper of grain refined bronze can be stronger than a hard, more brittle temper of traditional bronze.

While nickel iron grain refiners are known to increase low tin bronze strength, they are not known to increase sound quality.

Low tin bronze alloys are thought to be to high pitched, and of narrow range compared to equal high tin alloys in sound quality.

In a preferred embodiment, the instrument is a bronze alloy instrument composed of about 7 to 16 percent tin, said alloy containing between about 0.02 to 0.50 percent each of nickel and iron for use as grain refining agents, less than 0.50% phosphorous and less than 1% total trace elements, and the remainder copper.

The inventor has found that by using nickel iron grain refiners in low tin, more affordable and workable alloys, a percussion and cymbal maker can increase taper, use of heat zones, depth and greater variations of hammering and other processes which create a structurally more complex instrument to realize a product of superior complexity of overtone structure, higher strength and a product which lends itself to greater affordability of quality control. Such processes such as greatly increased tapering would weaken common alloys but the added strength provided by nickel iron grain refiners allows the use of these special processes and features. Current manufacturers of cymbals teach away from using low tin alloys for high quality percussion instruments by mentioning that their own product lines made of low tin alloys are of affordable, mass produced and identical quality when compared to their high tin alloy products: reference—Sabian.com advertising in referring to low tin alloy called B8 phrases point to an image of affordability "rapid tech virtual cloning". Limited range of overtone structure is advertised: "focused sound," "Lowest possible prices" all teach away from low tin alloys for use in quality cymbals.

The Zildjian company (the leading cymbal maker) advertises "ultra modern crafting techniques", "higher pitch", "more focused overtones", "identical discs". Such phrases teach away from very high quality to cymbal consumers, who regard hand crafting and a wider range of overtones desirable in cymbals. See http://www.zildjian.com/en-US/products/default.ad2. Conversely the same companies promote their high tin products as works of art with centuries old secret processes which yield high quality, all of which begins with their 20% tin alloy. The use of nickel-iron grain refiners in this invention offers a method to create new cymbal and bell embodiments of high quality and novel sound.

It should be understood that the preceding is merely a detailed description of one or more embodiments of this invention and that numerous changes to the disclosed embodiments can be made in accordance with the disclosure herein without departing from the spirit and scope of the invention. The preceding description, therefore, is not meant to limit the scope of the invention. Rather, the scope of the invention is to be determined only by the appended claims and their equivalents.

What is claim is:

1. A percussion instrument wherein said percussion instrument is formed using a melting or friction process in the manufacture of said percussion instrument, wherein said percussion instrument is a cymbal or a thin sectioned, metal sheet instrument, and wherein said percussion instrument comprises one or more holes at desired locations with a thicker section of metal around an edge of said one or more holes, wherein said one or more holes are created by melting or use of friction drilling of an existing metal section at respective locations where said one or more holes are desired, resulting in the thicker section of metal around the edge of said one or more holes.

2. The percussion instrument according to claim 1, wherein said instrument is a compound bell or cymbal instrument.

3. A percussion instrument wherein said percussion instrument is formed using a welding process in the manufacture of said percussion instrument, wherein said percussion instrument is a cymbal or a thin sectioned, metal sheet instrument, wherein one or more sections of differing thicknesses are joined by said welding process.

4. The percussion instrument according to claim 3, wherein said instrument is a compound bell and/or cymbal instrument.

5. The percussion instrument according to claim 3, wherein said instrument is a hybrid cymbal/bell instrument which possesses the sound quality of either a bell or cymbal.

6. The percussion instrument according to claim 3, wherein one or more sections of differing alloys and/or hardness are joined by said welding process.

7. A percussion instrument wherein said percussion instrument utilizes a welding process in the manufacture of said percussion instrument, wherein said percussion instrument is a cymbal or a thin sectioned, metal sheet instrument, wherein a molten bead or section of metal is added to one more desired locations on a surface of the instrument.

8. The percussion instrument according to claim 7, wherein said instrument is a compound bell and/or cymbal instrument.

9. The percussion instrument according to claim 7, wherein said instrument is a cymbal further comprising a plurality of weld beads on a surface of the cymbal wherein a cross-section thickness of each of said weld beads is progressively thinner as the weld bead extends toward an outer perimeter of the instrument.

10. The percussion instrument according to claim 7, wherein one or more sections of differing alloys and/or hardness are joined by said welding process.

11. A percussion instrument wherein said percussion instrument utilizes a welding process in the manufacture of said percussion instrument, wherein said percussion instrument is a cymbal, wherein one or more sections or welded beads of metal are joined by said welding process and said instrument is made from a steel alloy.

12. A percussion instrument wherein said percussion instrument utilizes a welding process in the manufacture of said percussion instrument, wherein said percussion instrument is a cymbal or a bell instrument, wherein two or more cymbals or bells are joined together through welding to create a compound bell or compound cymbal instrument, and wherein said joined two or more cymbals are joined in proximity resulting in a common resonating air cavity.

13. The percussion instrument according to claim 12, wherein two or more dome-shaped or cymbal shaped sections of metal are welded together so that each center dome is oriented in an opposite direction to each outer section.

14. The percussion instrument according to claim 12, wherein said instrument comprises a cymbal with one or more cups, domes, bells or weights affixed to said cymbal by means of a welding process wherein said cups, domes, bells or weights are welded to a center area of said cymbal.

15. A percussion instrument wherein said percussion instrument utilizes a friction drilling process in the manufacture of said percussion instrument, wherein said percussion instrument is a cymbal or a thin sectioned, metal sheet instrument, wherein said percussion instrument has one or more flared holes for creating a smooth interior edge around said holes whereby said flaring strengthens the area where said instrument is mounted or suspended and alters the sound of said instrument.

* * * * *